US011363395B1

(12) United States Patent
Toride et al.

(10) Patent No.: US 11,363,395 B1
(45) Date of Patent: Jun. 14, 2022

(54) MINIATURE FOLDED TRANSDUCER

(71) Applicant: Facebook Technologies, LLC, Menlo Park, CA (US)

(72) Inventors: Yuri Toride, Redmond, WA (US); Chuming Zhao, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/133,026

(22) Filed: Dec. 23, 2020

(51) Int. Cl.

| | |
|---|---|
| ***H04R 29/00*** | (2006.01) |
| ***H04R 19/04*** | (2006.01) |
| ***H04R 1/10*** | (2006.01) |
| ***H04R 17/02*** | (2006.01) |
| ***H04R 1/04*** | (2006.01) |
| ***H04R 1/08*** | (2006.01) |

(52) U.S. Cl.
CPC ..... *H04R 29/004* (2013.01); *H04R 1/04* (2013.01); *H04R 1/08* (2013.01); *H04R 1/1008* (2013.01); *H04R 17/02* (2013.01); *H04R 19/04* (2013.01); *H04R 2201/003* (2013.01)

(58) Field of Classification Search
None
See application file for complete search history.

(56) References Cited

U.S. PATENT DOCUMENTS 7,500,954 B2 * 3/2009 Wilser ..... A61B 8/12 600/459
2020/0382876 A1 * 12/2020 Cerini ..... B81C 1/00166

OTHER PUBLICATIONS

Cordourier-Maruri, H. A. et al. "V-Speech: Noise-Robust Speech Capturing Glasses Using Vibration Sensors." Proc. ACM Interact. Mob. Wearable Ubiquitous Technol., vol. 2, No. 4, Dec. 2018, pp. 1-23.
Fischer, A. C. et al. "Integrating MEMS and ICs." Microsystems & Nanoengineering, vol. 1, May 2015, pp. 1-16.
Gerfers, F. et al. "An Ultra Low-Noise Vibration Monitoring System." IEEE Sensors 2007 Conference, Oct. 28-31, 2007, pp. 880-883.

* cited by examiner

*Primary Examiner* — Kenny H Truong
(74) *Attorney, Agent, or Firm* — Fenwick & West LLP

(57) ABSTRACT

A piezoelectric microelectromechanical systems (MEMS) transducer that can operate as a microphone (e.g., contact microphone) or a speaker is presented herein. The piezoelectric MEMS transducer includes a substrate, a proof mass and folded displacement sensing structures. Each folded displacement sensing structure comprises a continuous beam, a first piezoelectric stress sensor coupled to a first portion of the continuous beam, and a second piezoelectric stress sensor coupled to a second portion of the continuous beam. The first portion of the continuous beam is coupled to a respective portion of the proof mass, and the second portion of the continuous beam is coupled to a respective portion of the substrate. The first and second portions of the continuous beam come together at an acute angle. The first and second piezoelectric stress sensors output stress information responsive to a stress induced in the continuous beam by displacement of the proof mass.

20 Claims, 9 Drawing Sheets
(3 of 9 Drawing Sheet(s) Filed in Color)

600

MINIATURE FOLDED TRANSDUCER

FIELD OF THE INVENTION

The present disclosure relates generally to a transducer, and specifically relates to a miniature folded transducer.

BACKGROUND

A contact transducer (or contact microphone) is a vibration sensor or an accelerometer that detects an acoustic wave through a contact surface. Because the contact transducer is only susceptible to a surface vibration, its immunity to airborne sound and environmental factors (e.g., background noise, wind, water, dust, etc.) is advantageous for integration in various wearable devices including, e.g., in-ear monitors, head-mounted devices, smart glasses, smart watches, etc. However, a footprint size of the contact transducer still presents a considerable challenge for fitting the contact transducer within compact form-factor wearable devices.

SUMMARY

Embodiments of the present disclosure support a miniature folded transducer implemented as a piezoelectric microelectromechanical systems (MEMS) transducer. In some embodiments, the piezoelectric MEMS transducer is configured to operate as a microphone (e.g., a contact microphone). The piezoelectric MEMS transducer presented herein comprises a proof mass and plurality of folded displacement sensing structures. Each folded displacement sensing structure comprises a continuous beam, a first piezoelectric stress sensor coupled to a first portion (e.g., a top side) of the continuous beam, and a second piezoelectric stress sensor coupled to a second portion (e.g., a bottom side opposite to the top side) of the continuous beam. The first portion of the continuous beam is coupled to a respective portion of the proof mass, and the second portion of the continuous beam is coupled to a respective portion of the substrate. The first and second portions of the continuous beam come together at an acute angle. The first and second piezoelectric stress sensors are configured to output stress information (e.g., charge or voltage) responsive to a stress induced in the continuous beam by displacement of the proof mass.

In some embodiments, the piezoelectric MEMS transducer is part of an audio system integrated into a headset. The piezoelectric MEMS transducer may be coupled to a surface of a skin of a user wearing the headset.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Figure 1A:
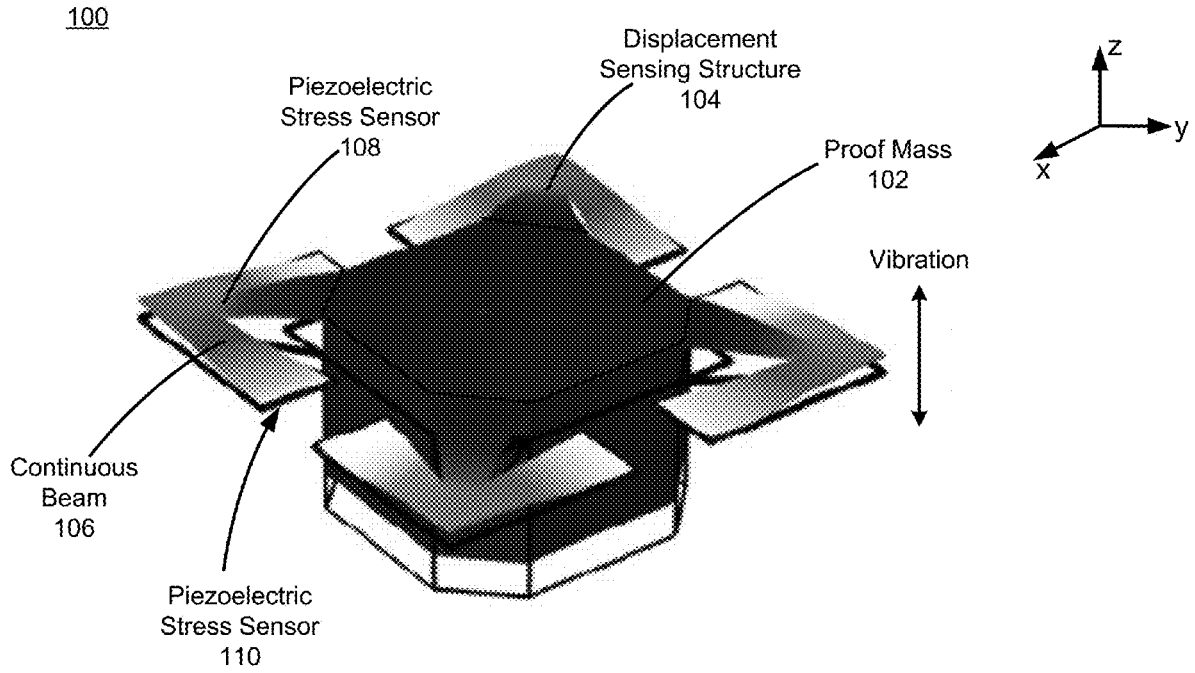
FIG. 1A illustrates a perspective view of a piezoelectric microelectromechanical systems (MEMS) transducer, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments of the present disclosure relate to a miniature folded transducer implemented as a piezoelectric microelectromechanical systems (MEMS) transducer. The MEMS technology is leveraged herein for designing a small form-factor and low-power folded transducer covering a wide frequency bandwidth. In some embodiments, the piezoelectric MEMS transducer is configured to operate as a microphone. In some other embodiments, the piezoelectric MEMS transducer is configured to operate as a speaker. In some cases, the piezoelectric MEMS transducer can be used as a contact microphone, tissue transducer, vibrometer, etc.

The piezoelectric MEMS transducer presented herein includes, among other components, a proof mass on top of a substrate, wherein the proof mass is coupled to multiple folded displacement sensing structures. Each folded displacement sensing structure of the piezoelectric MEMS transducer includes a tapered continuous beam (i.e., suspension or sensing beam) and a pair of piezoelectric stress sensors (or piezoelectric layers). The continuous beam includes a first portion (i.e., a top side) that is coupled to a respective portion of the proof mass, and a second portion (i.e., a bottom side opposite to the top side) that is coupled to a respective portion of the substrate. The first portion of the continuous beam and the second portion of the continuous beam come together at an acute angle. One piezoelectric stress sensor (i.e., one piezoelectric layer) is coupled to the first portion of the continuous beam, whereas the other piezoelectric stress sensor (i.e., the other piezoelectric layer) is coupled to the second portion of the continuous beam. The pair of piezoelectric stress sensors output stress information (e.g., charge or voltage) responsive to the stress induced in the continuous beam by displacement of the proof mass.

One advantage of the piezoelectric MEMS transducer presented herein is usage of a tapered continuous beam instead of a uniform beam typically used in the similar conventional transducers. The usage of tapered continuous beam improves a stress distribution by concentrating the stress more effectively at a smaller sensing area, thus resulting into an increased sensitivity within a smaller footprint. Another advantage of the piezoelectric MEMS transducer presented herein is more efficient utilization of a space on the substrate. By utilizing the folded displacement sensing structures, an amount of unused space between the proof mass and the folded displacement sensing structures is reduced in comparison with the similar conventional transducers. Thus, the piezoelectric MEMS transducer presented herein can be fabricated with a smaller footprint than the similar conventional transducers while providing a high level of sensitivity.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A illustrates a perspective view of a piezoelectric MEMS transducer 100, in accordance with one or more embodiments. In one embodiment, the piezoelectric MEMS transducer 100 operates as a microphone (e.g., a contact microphone). In another embodiment, the piezoelectric MEMS transducer 100 operates as a speaker (e.g., a contact speaker). In general, the piezoelectric MEMS transducer 100 operates as a folded transducer having a small form factor. The piezoelectric MEMS transducer 100 comprises a proof mass 102 located above a substrate (not shown in FIG. 1A), and a plurality of folded displacement sensing structures 104 (e.g., mechanical suspension structures). The piezoelectric MEMS transducer 100 may further include a frame (not shown in FIG. 1A), i.e., a fixed structure that the folded displacement sensing structures 104 couple to in order to suspend the proof mass 102. In some other embodiments, the MEMS transducer 100 may comprise additional or fewer components.

The proof mass 102 is supported with the folded displacement sensing structures 104 each having a continuous beam 106. The continuous beam 106 represents a suspension and sensing structure. Opposite sides (i.e., top and bottom surfaces) of the continuous beam 106 include piezoelectric layers, i.e., piezoelectric stress sensors 108, 110. The piezoelectric stress sensor 108 is coupled to a first portion (i.e., a top surface) of the continuous beam 106 that is coupled to a respective portion of the proof mass 102. The piezoelectric stress sensor 110 is coupled to a second portion (i.e., a bottom surface opposite to the top surface) of the continuous beam 106 that is coupled to a respective portion of the substrate. The first and second portions of the continuous beam 106 come together at an acute angle, and are opposite to each other.

The continuous beam 106 may comprise at least one layer of piezoelectric material (e.g., at least one piezoelectric thin film) sandwiched by electrode layers (e.g., conductive material layers). In one embodiment, the continuous beam 106 comprises a piezoelectric unimorph material, i.e., one active piezoelectric layer. In such case, the continuous beam 106 may comprise an electrode-piezo-electrode stack, i.e., the active piezoelectric layer is sandwiched by the electrode layers. In another embodiment, the continuous beam 106 comprises a piezoelectric bimorph material, i.e., two active piezoelectric layers. In yet another embodiment, the continuous beam 106 comprises a piezoelectric multimorph material, i.e., multiple active piezoelectric layers stack. The piezoelectric layer(s) of the continuous beam 106 can be implemented using, e.g., aluminum nitride (AlN), scandium doped aluminum nitride (AlScN), lead zirconate titanate (PZT), zinc oxide (ZnO), lead magnesium niobate-lead titanate (PMN-PT), some other chemical composition, or combination thereof. The electrode layers coupled to the piezoelectric layer(s) of the continuous beam 106 may be implemented using, e.g., molybdenum (Mo), platinum (Pt), titanium (Ti), some other conductive material, or combination thereof. In some embodiments, the continuous beam 106 also includes a supporting layer (e.g., silicon or silicon dioxide) implemented as a bottom layer of the continuous beam 106, e.g., placed underneath the electrode-piezo-electrode stack of the continuous beam 106.

The proof mass 102 may be implemented using a substrate material, e.g., silicon. The substrate material of the proof mass 102 may be etched away from the piezoelectric material of the continuous beams 106. In some embodiments, there is a layer deposited through the proof mass 102 and the continuous beams 106. In one embodiment, the deposited layer is a piezoelectric thin film coated on top of the substrate material of the proof mass 102. In another embodiment, the deposited layer represents the supporting layer of the continuous beam 106. The continuous beams 106 and the proof mass 106 are connected tightly to each other, e.g., via the deposited layer.

As shown on FIG. 1A, a vibration of the piezoelectric MEMS transducer 100 (e.g., due to sound waves) displaces the proof mass 102 (e.g., along the z axis) and deforms the continuous beams 106. The deformation of each continuous beam 106 stresses piezoelectric films in the piezoelectric stress sensors 108, 110, and thus generates charge at each surface of a corresponding piezoelectric layer 108, 110 due to the direct piezoelectric effect. The generated charge or an amplified voltage (e.g., generated by a charge amplifier) can be measured as a differential output at, e.g., electrodes coupled to the piezoelectric layers of the piezoelectric stress sensors 108, 110 at opposite surfaces of the continuous beam 106.

The piezoelectric stress sensors 108, 110 are configured to output stress information responsive to a stress induced in the continuous beam 106 by displacement of the proof mass 102. The first portion of the continuous beam 106 coupled to the respective portion of the proof mass 102 may be under tension by displacement of the proof mass 102 resulting into an output of the piezoelectric stress sensor 108 having a first polarity (e.g., positive polarity). The second portion of the continuous beam 106 coupled to the respective portion of the substrate may be under compression by displacement of the proof mass 102 resulting into an output of the piezoelectric stress sensor 110 having a second polarity (e.g., negative polarity) opposite to the first polarity. The outputs of the piezoelectric stress sensors 108, 110 form the output stress information, which can be either charge information or voltage information.

In one embodiment, the piezoelectric stress sensor 108 comprises a first unimorph piezoelectric layer, and the piezoelectric stress sensor 110 comprises a second unimorph piezoelectric layer. A unimorph piezoelectric layer is composed of a single active piezoelectric layer. In another embodiment, the piezoelectric stress sensor 108 comprises a first bimorph piezoelectric layer, and the piezoelectric stress sensor 110 comprises a second bimorph piezoelectric layer. A bimorph piezoelectric layer is composed of a pair of active piezoelectric layers with, e.g., a passive layer between the active piezoelectric layers. Each piezoelectric layer of the piezoelectric stress sensors 108, 110 can be implemented using, e.g., AlN, PZT, ZnO, AlScN, PMN-PT, some other chemical composition, or combination thereof. In a preferred embodiment, each of the piezoelectric stress sensors 108, 110 comprises a bimorph piezoelectric layer, e.g., for achieving high electromechanical coupling efficiency.

Figure 1B:
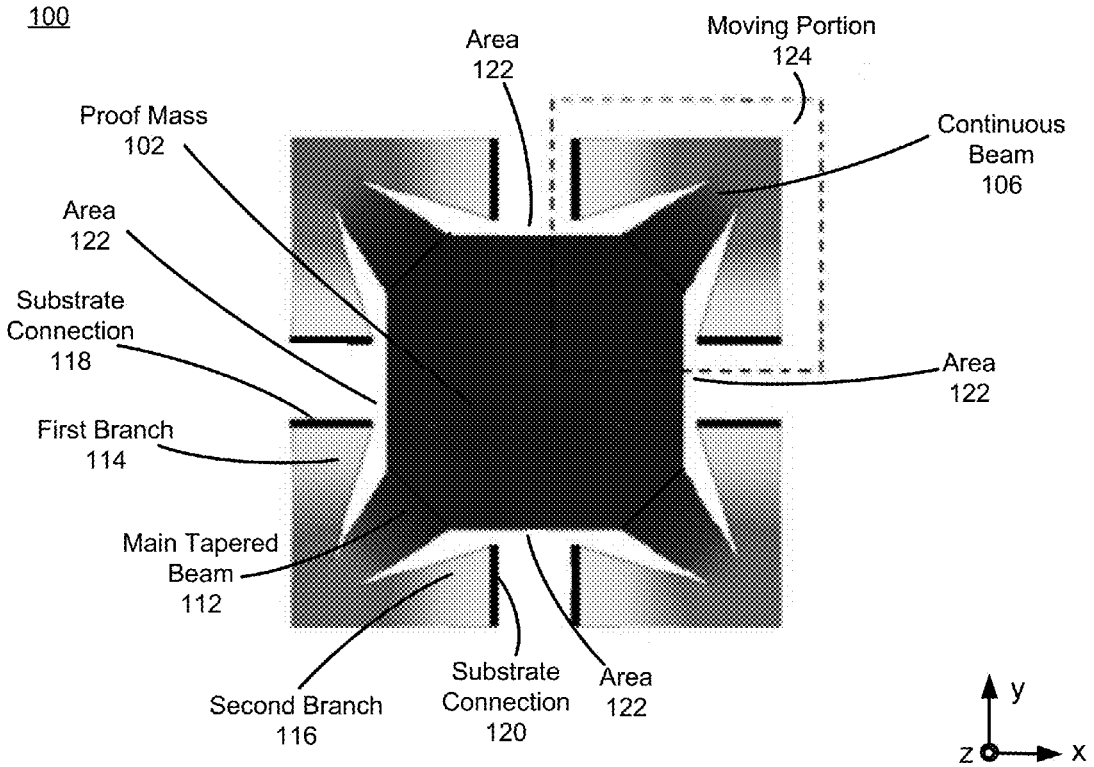
FIG. 1B illustrates a top-view of the piezoelectric MEMS transducer of FIG. 1A.

FIG. 1B illustrates a top-view of the piezoelectric MEMS transducer 100. Each continuous beam 106 shown in FIGS. 1A-1B is implemented as a folded tapered suspension beam. As illustrated in FIG. 1B, each continuous beam 106 includes three tapered components, i.e., a main tapered beam 112 that couples to the proof mass 102, a first branch 114 that couples the continuous beam 106 to the frame (not shown in FIG. 1B) at a substrate connection 118, and a second branch 116 that couples the continuous beam 106 to the frame at a substrate connection 120.

As aforementioned, one advantage of the folded design of continuous beams 106 is more efficient utilization of a space on the substrate. By using the folded beam approach presented herein where the continuous beams 106 is bent back upon themselves instead of being completely straight, an amount of unused space (i.e., an area 122) between the proof mass 102 and the folded displacement sensing structures 104 (or equivalently the continuous beams 106) is reduced (i.e., below a threshold area) while maintaining a signal-to-noise ratio (SNR) of the piezoelectric MEMS transducer 100 at a desired level (i.e., above a defined threshold value). This facilitates a small form factor of the piezoelectric MEMS transducer 100 while providing a high level of sensitivity of the piezoelectric MEMS transducer 100. It should be noted that the area 122 between the proof mass 102 and the continuous beams 106 is free of any rigid structure, i.e., the area 122 is able to flex under the stress thus providing increased sensitivity.

Figure 1C:
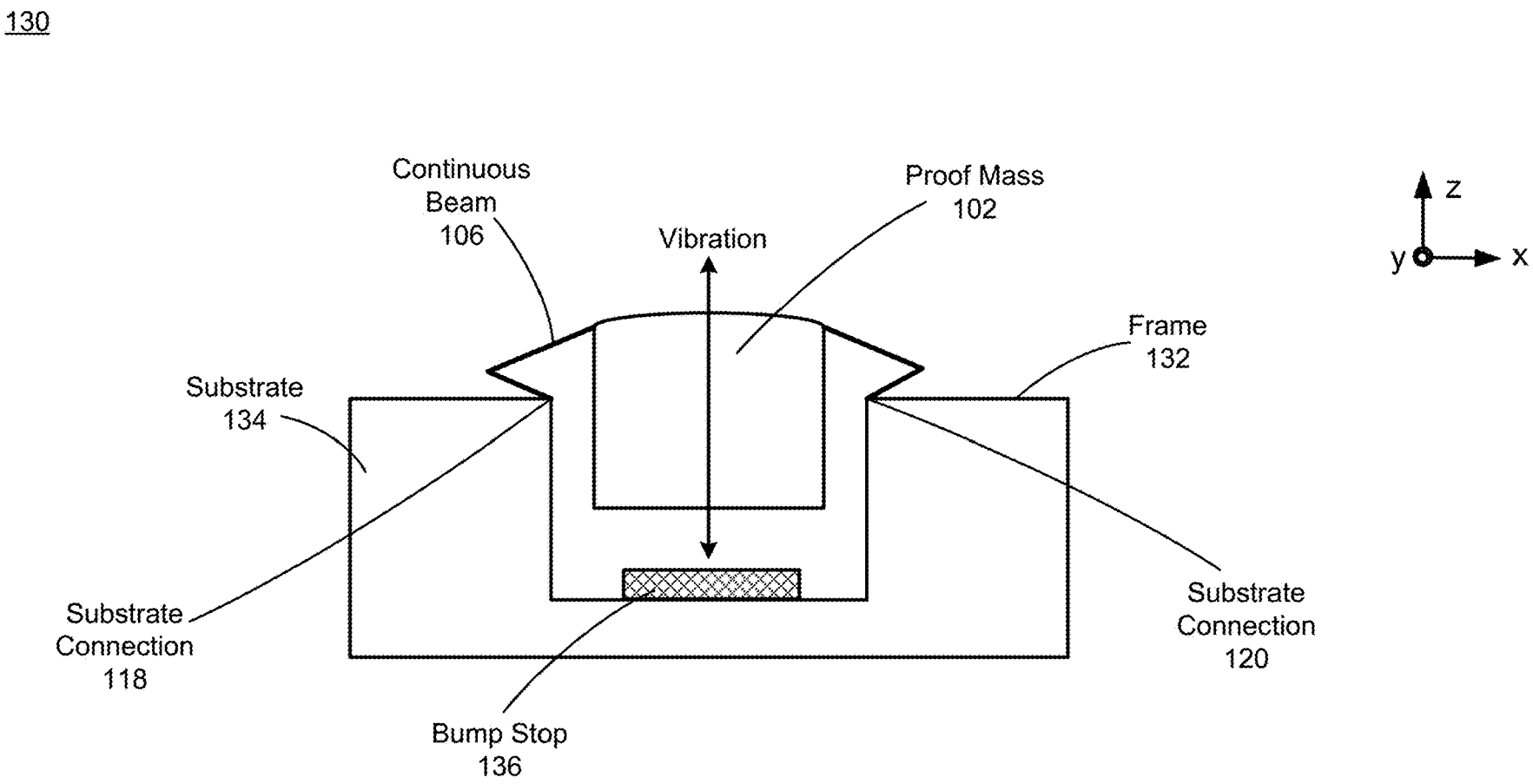
FIG. 1C illustrates a side-view of the piezoelectric MEMS transducer of FIG. 1A.

FIG. 1C illustrates a side-view 130 of the piezoelectric MEMS transducer 100. The side-view 130 shows a portion of continuous beam 106 coupled at the substrate connections 118, 120 to a frame 132. As aforementioned, the frame 132 is a fixed structure that the continuous beams 106 couple to in order to suspend the proof mass 102 (e.g., to limit undesired vibrations of the proof mass 102). The frame 132 is formed from a substrate 134 and/or on the substrate 134. The frame 132 provides an increased robustness to the piezoelectric MEMS transducer 100. Each continuous beam 106 is coupled to a respective portion of the frame 132.

In some embodiments, the piezoelectric MEMS transducer 100 include one or more bump stops. A bump stop is a flexible structure designed to make contact between the frame 132 and one or more moving portions of the piezoelectric MEMS transducer 100 (e.g., the continuous beam 106 and/or the proof mass 102) at designated area(s) with an enough level of restoring force to restrict a range of movement of the moving portion(s). The bump stop can, e.g., prevent from stiction during a fabrication process of the piezoelectric MEMS transducer 100, from failure of the continuous beams 106 from drop shocks, excess vibrations of the proof mass 102 and/or the continuous beams 106 that can negatively affect sensitivity of the piezoelectric MEMS transducer 100, etc. In one or more embodiments, bump stops (e.g., implemented as rubber pads) can be placed between portions of the frame 132 and portions of the continuous beam 106 restricting a range of movement (e.g., vibration along z axis) of the continuous beam 106. Alternatively or additionally, as illustrated in FIG. 1C, a bump stop 136 (e.g., implemented as a rubber pad) can be placed below the proof mass 102 (i.e., between the proof mass and the substrate 134) to restrict a range of movement (e.g., vibration along z axis) of the proof mass 102. A bump stop implemented as a rubber pad may be also positioned at a top of the proof mass 102 (not shown in FIG. 1C). In some embodiments, in addition to the bump stop(s), the piezoelectric MEMS transducer 100 can include one or more stress isolation structures (not shown in FIG. 1C) that are configured to improve durability of the piezoelectric MEMS transducer 100.

Figure 2:
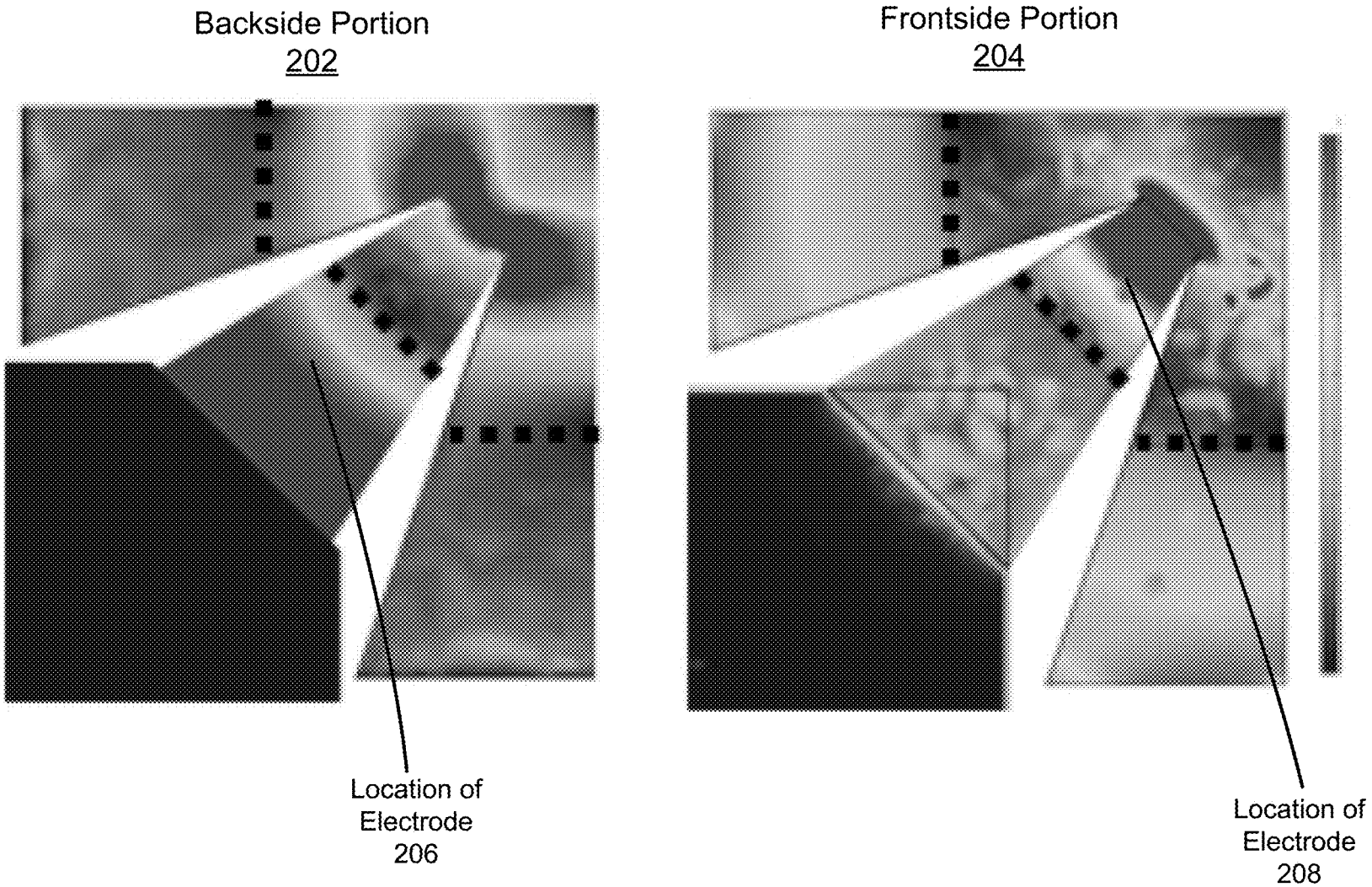
FIG. 2 illustrates a bottom view and a top-view of a stress distribution over a portion of the piezoelectric MEMS transducer of FIG. 1A.

FIG. 2 illustrates a bottom view and a top-view of a stress distribution over a moving portion 124 of the piezoelectric MEMS transducer 100. As shown in FIG. 1, the moving portion 124 includes one continuous beam 106 and a corresponding portion of the proof mass 102 coupled to that continuous beam 106. As discussed above, the piezoelectric MEMS transducer 100 utilizes the tapered continuous beams 106. Usage of the tapered continuous beam 106 instead of a uniform beam improves a stress distribution by concentrating the stress more effectively at a smaller sensing area, thus resulting into an increased charge sensitivity within a smaller footprint. Both top and bottom sides of the tapered continuous beam 106 can be utilized for a differential sensing of sound waves, e.g., a backside portion 202 and a frontside portion 204, as shown in FIG. 2. When the vibration due to sound waves occurs, some or all of the backside portion 202 (e.g., the bottom side coupled to the substrate 122) may be under compression, whereas some or all of the frontside portion 204 (e.g., the top side coupled to the proof mass 104) may be under tension, thus resulting into opposite polarity sensing output (e.g., charge or voltage).

FIG. 2 shows stress profiles of the backside portion 202 and of the frontside portion 204. It should be noted that red regions in FIG. 2 are regions with high levels of compression (i.e., high positive levels of stress), whereas blue regions in FIG. 2 are regions with high levels of tension (i.e., high negative levels of stress). It can be observed that high stress concentration areas (e.g., red and blue regions in FIG. 2) are located at complementary locations of the backside portion 202 and the frontside portion 204 of the tapered continuous beam 106. The dashed lines in FIG. 2 represent separations of electrodes for differential sensing. The electrodes (i.e., conductive layers, not shown in FIG. 2) can be located at the complementary locations of the backside portion 202 and the frontside portion 204, i.e., at the locations 206 and 208 where the levels of compression and tension are the highest. The electrodes can be thus located on top and bottom sides of the continuous beam 106 at different sides of the dashed lines, while piezoelectric layers of the continuous beam 106 (i.e., the piezoelectric stress sensors 108, 110) are sandwiched by the conductive layers.

Referring back to FIGS. 1A-1B, the continuous beam 106 is a tapered beam of an arrow form, i.e., the continuous beam 106 resembles a tapered arrow. The arrow form represents a form of a beam that has a wedge-shaped end. Note that smallest off-the-shelf MEMS sensors (e.g., accelerometers and microphones) are typically limited to an area size of 2 mm by 2 mm. Due to the working principle of an accelerometer by nature, shrinking an area size of the MEMS transducer device reduces its mass and consequently degrades the sensitivity (which is proportional to mass). In addition, this results in a higher level of thermal-mechanical noise (which is inversely proportional to mass) at a higher frequency band. Implementation of the piezoelectric MEMS transducer 100 with the tapered continuous beams 106 of arrow forms can solve this miniaturizing problem.

In one or more embodiments, to achieve a miniature package size for the piezoelectric MEMS transducer 100 (e.g., smaller than 3 $mm^2$ in footprint), the piezoelectric MEMS transducer 100 can be designed with a raw die size having one dimension (e.g., length or width) between 100 um and 1 mm and another dimension (e.g., width or length) between 100 um and 1 mm, thus providing the raw die size being less than 1 $mm^2$ in footprint. The piezoelectric MEMS transducer 100 may feature the resonant frequency between, e.g., approximately 1 kHz and 10 kHz, the noise density less than, e.g., 200 ug/rt-Hz, the acceleration limit (yield strength, fracture stress, whichever is lower) between, e.g., 5 kg and 20 kg for drop shock, while operating at less than 10% THD (total harmonic distortion) for the vibration equivalent to between 100 dBSPL and 120 dBSPL (decibel sound pressure level).

Figure 3A:
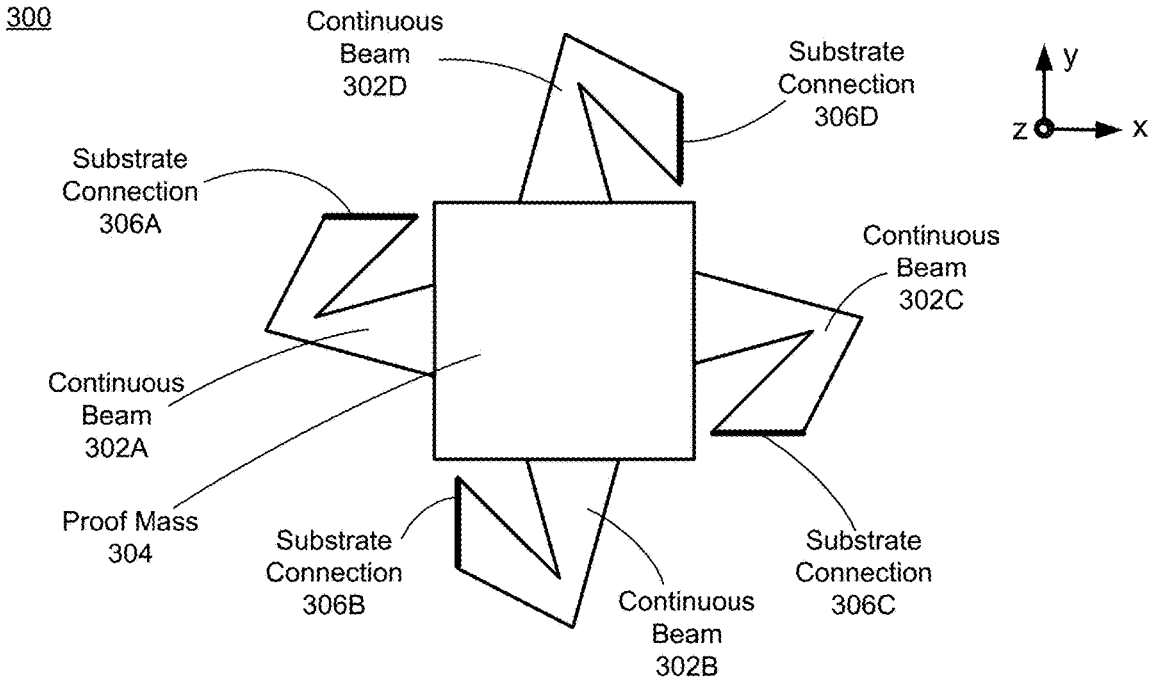
FIG. 3A illustrates a top view of a first example of a piezoelectric MEMS transducer with tapered continuous beams, in accordance with one or more embodiments.

A number and an exact shape of tapered continuous beams in a miniature folded piezoelectric MEMS transducer can be flexible, as illustrated in FIGS. 3A-3D. FIG. 3A illustrates a top view of a first example of a piezoelectric MEMS transducer 300 with tapered continuous beams 302A-302D, in accordance with one or more embodiments. The piezoelectric MEMS transducer 300 operates in substantially the same manner as the piezoelectric MEMS transducer 100. The piezoelectric MEMS transducer 300 includes four tapered continuous beams 302A, 302B, 302C, 302D of the arrow form coupled to a proof mass 304 of a rectangular (or square) shape. The continuous beams 302A, 302B, 302C, 302D are mounted on a frame (not shown in FIG. 3A) at substrate connections 306A, 306B, 306C, 306D, respectively. The proof mass 304 is substantially the same as the proof mass 102 except that a shape of the proof mass 304 is different than that of the proof mass 102 (i.e., rectangular shape vs. circular shape). The continuous beams 302A, 302B, 302C, 302D are substantially the same to the continuous beams 106 except that an exact shape of each continuous beam 302A, 302B, 302C, 302D is different than that of the continuous beam 106, i.e., the arrow form of each continuous beam 302A, 302B, 302C, 302D is different than that of the continuous beam 106.

Figure 3B:
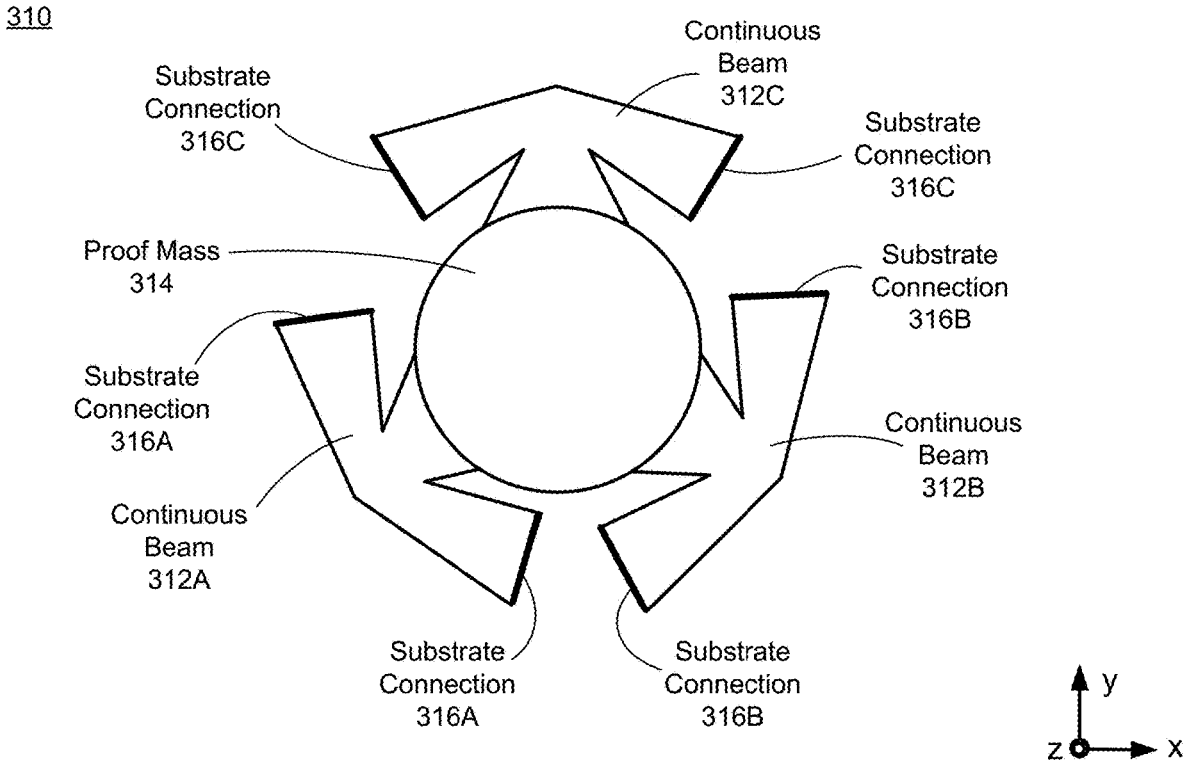
FIG. 3B illustrates a top view of a second example of a piezoelectric MEMS transducer with tapered continuous beams, in accordance with one or more embodiments.

FIG. 3B illustrates a top view of a second example of a piezoelectric MEMS transducer 310 with tapered continuous beams 312A-312C, in accordance with one or more embodiments. The piezoelectric MEMS transducer 310 operates in substantially the same manner as the piezoelectric MEMS transducer 100. The piezoelectric MEMS transducer 310 includes three tapered continuous beams 312A, 312B, 312C of the arrow form coupled to a proof mass 314 of a circular (ring) shape. The continuous beams 312A, 312B, 312C are mounted on a frame (not shown in FIG. 3B) at substrate connections 316A, 316B, 316C, respectively. The proof mass 314 is substantially the same as the proof mass 102. The continuous beams 312A, 312B, 312C are substantially the same to the continuous beams 106 except that an exact shape of each continuous beam 312A, 312B, 312C is different than that of the continuous beam 106, i.e., the arrow form of each continuous beam 312A, 312B, 312C is different than that of the continuous beam 106.

Figure 3C:
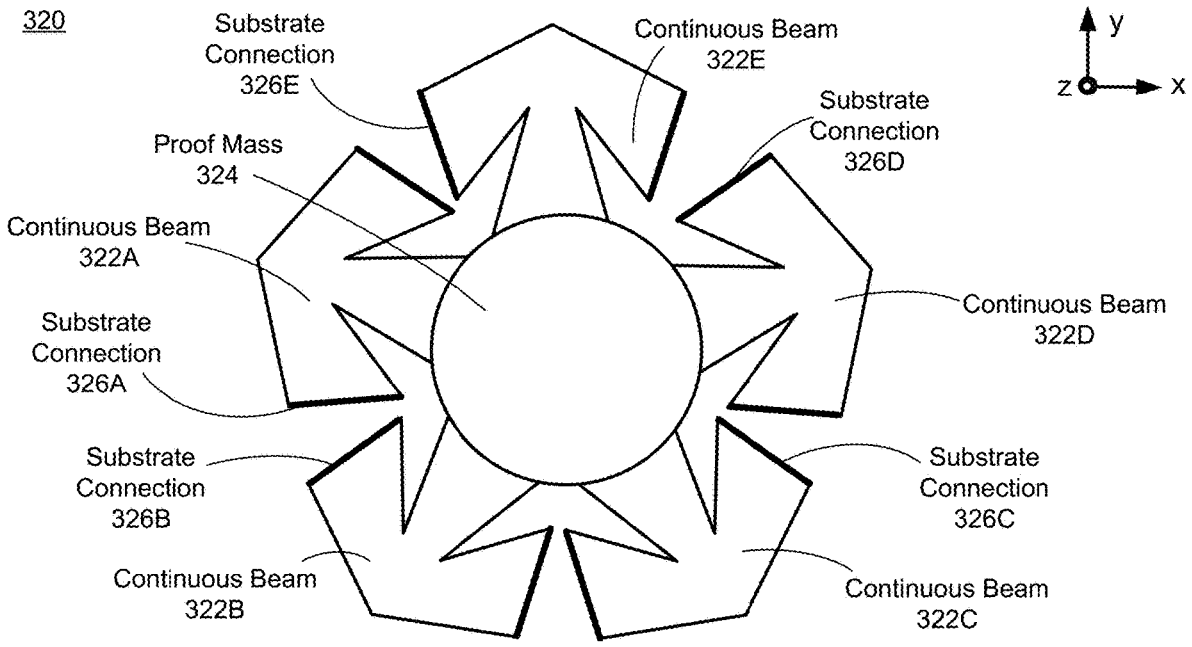
FIG. 3C illustrates a top view of a third example of a piezoelectric MEMS transducer with tapered continuous beams, in accordance with one or more embodiments.

FIG. 3C illustrates a top view of a third example of a piezoelectric MEMS transducer 320 with tapered continuous beams 322A-322E, in accordance with one or more embodiments. The piezoelectric MEMS transducer 320 operates in substantially the same manner as the piezoelectric MEMS transducer 100. The piezoelectric MEMS transducer 320 includes five tapered continuous beams 322A, 322B, 322C, 322D, 322E of the arrow form that are coupled to a proof mass 324 of a circular (ring) shape. The continuous beams 322A, 322B, 322C, 322D, 322E are mounted on a frame (not shown in FIG. 3C) at substrate connections 326A, 326B, 326C, 326D, 326E, respectively. The proof mass 324 is substantially the same as the proof mass 102. The continuous beams 322A, 322B, 322C, 322D, 322E are substantially the same to the continuous beams 106 except that an exact shape of each continuous beam 322A, 322B, 322C, 322D, 322E is different than that of the continuous beam 106, i.e., the arrow form of each continuous beam 322A, 322B, 322C, 322D, 322E is different than that of the continuous beam 106.

Figure 3D:
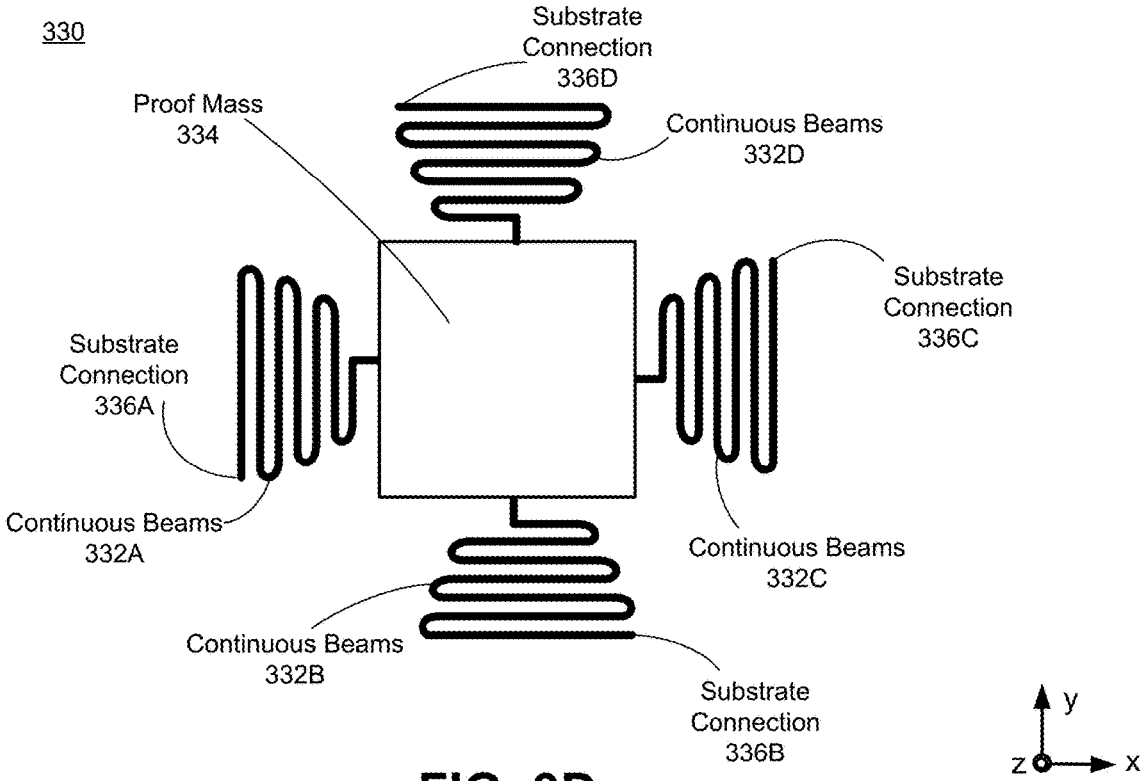
FIG. 3D illustrates a top view of a fourth example of a piezoelectric MEMS transducer with continuous beams, in accordance with one or more embodiments.

FIG. 3D illustrates a top view of a fourth example of a piezoelectric MEMS transducer 330 with continuous beams 332A-332D, in accordance with one or more embodiments. The piezoelectric MEMS transducer 330 operates in substantially the same manner as the piezoelectric MEMS transducer 100. The piezoelectric MEMS transducer 330 includes four continuous beams 332A, 332B, 332C, 332D of a serpentine form that are coupled to a proof mass 324 of a rectangular (square) shape. The continuous beams 332A, 332B, 332C, 332D are mounted on a frame (not shown in FIG. 3D) at substrate connections 336A, 336B, 336C, 336D, respectively. The proof mass 334 is substantially the same as the proof mass 102 except that a shape of the proof mass 334 is different than that of the proof mass 102 (i.e., rectangular shape vs. circular shape). The continuous beams 336A, 336B, 336C, 336D are substantially the same to the continuous beams 106 except that a form of each continuous beam 336A, 336B, 336C, 336D is different than that of the continuous beam 106 (i.e., the serpentine form vs. the arrow form).

One advantage of the folded/serpentine structures of the continuous beams shown in FIGS. 3A-3D is that each continuous beam of FIGS. 3A-3D utilizes a smaller space to create an effectively longer beam length, which increases sensitivity and decreases resonant oscillations (i.e., undesired vibrations) of a corresponding piezoelectric MEMS transducer. By having a sharp cut angle, each continuous beam of FIGS. 3A-3D facilitates a higher level of stress concentration on certain portions of the continuous beam, which substantially increases the sensitivity of the corresponding piezoelectric MEMS transducer. It should be noted that FIGS. 3A-3D illustrates the piezoelectric MEMS transducers that are implementation variations of the piezoelectric MEMS transducer 100. The piezoelectric MEMS transducers of FIGS. 3A-3D operate substantially the same but are different in shape (e.g., shape of the continuous beams and/or the proof mass) in order to accommodate different shape/size requirements.

Figure 4:
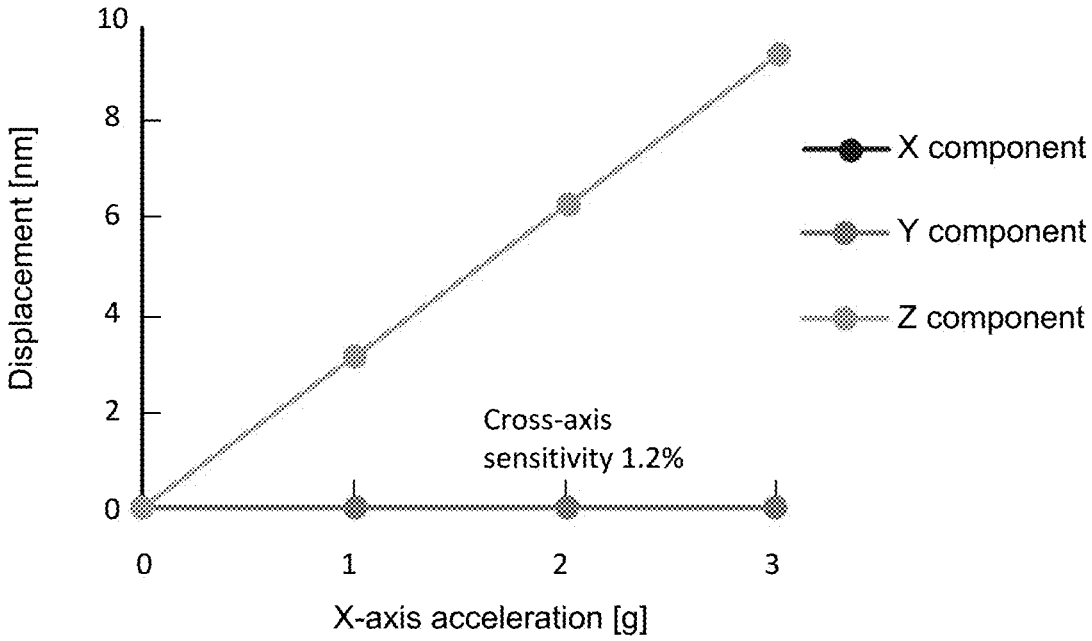
FIG. 4 is a graph illustrating a cross-axis sensitivity of a piezoelectric MEMS transducer as a function of acceleration, in accordance with one or more embodiments.

FIG. 4 is a graph 400 illustrating a cross-axis sensitivity of the piezoelectric MEMS transducer 100 as a function of acceleration, in accordance with one or more embodiments. The graph 400 shows the sensitivity of the piezoelectric MEMS transducer 100 in terms of displacement (e.g., in unit of [nm]) as a function of acceleration (e.g., in unit of gravitational force [g]) in different spatial dimensions. It can be observed from the graph 400 that the displacements along in-plane axes (e.g., x and y axes) are almost non-existent, whereas only displacement sensitivity is to out-of-plane axis (e.g., z axis) acceleration. Construction of the continuous beams 106 in the arrow form facilitates improvement of a cross-axis rigidity by allowing movement in the out-of-plane axis but limiting movement in the in-plane axes. It should be noted that that the cross-axis sensitivity may be suppressed to approximately 1.2% for the piezoelectric MEMS transducer 100.

Figure 5A:
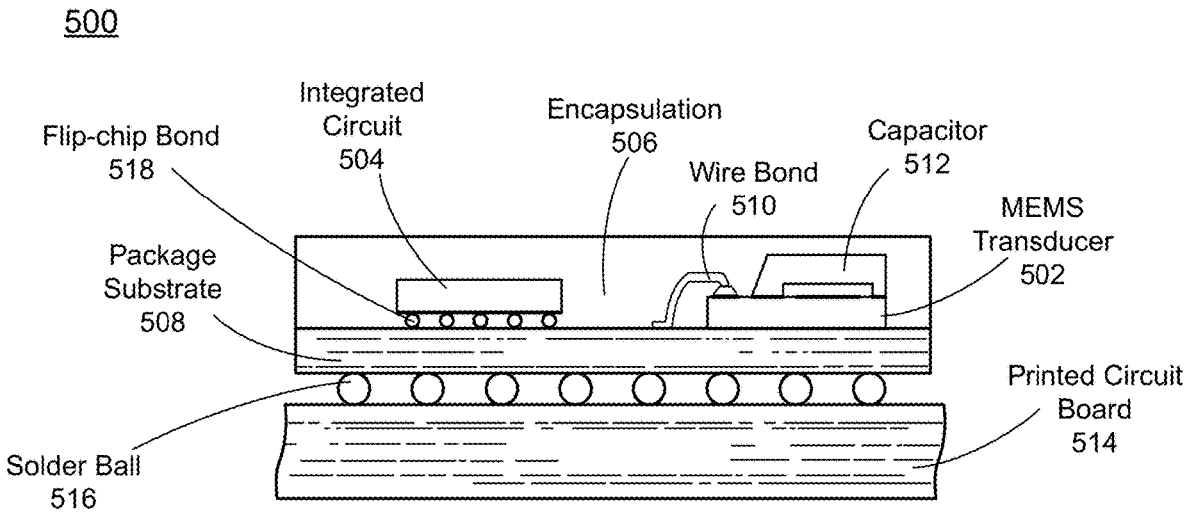
FIG. 5A illustrates a two-dimensional integration of a piezoelectric MEMS transducer with an integrated circuit, in accordance with one or more embodiments.

FIG. 5A illustrates a two-dimensional integration 500 of a MEMS transducer 502 with an integrated circuit 504, in accordance with one or more embodiments. The MEMS transducer 502 is an embodiment of the piezoelectric MEMS transducer 100 in FIGS. 1A-1B or an embodiment of any of the piezoelectric MEMS transducers 300, 310, 320, 330 in FIGS. 3A-3D. In one embodiment, the MEMS transducer 502 operates as a microphone (e.g., contact microphone). In another embodiment, the MEMS transducer 502 operates as a speaker (e.g., contact speaker). As shown in FIG. 5A, a die of the MEMS transducer 502 and a die of the integrated circuit 504 are encapsulated within a common encapsulation 506 and mounted two-dimensionally (e.g., horizontally) relative to each other onto a package substrate 508. The integrated circuit 504 may be an application-specific integration circuit (ASIC). A wire bond 510 may connect the MEMS transducer 502 with the package substrate 508. Furthermore, a capacitor 512 may be placed above the MEMS transducer 502. The package substrate 508 may be an embodiment of the substrate 134. The package substrate 508 can be coupled to a printed circuit board (PCB) 514, e.g., via multiple solder ball contacts 516. The integrated circuit 504 can be coupled to the package substrate 508 via multiple flip-chip bonds 518. The two-dimensional integration 500 has the advantage of keeping the encapsulation package 506 thinner, it is preferred for in-ear monitor (IEM) devices.

Figure 5B:
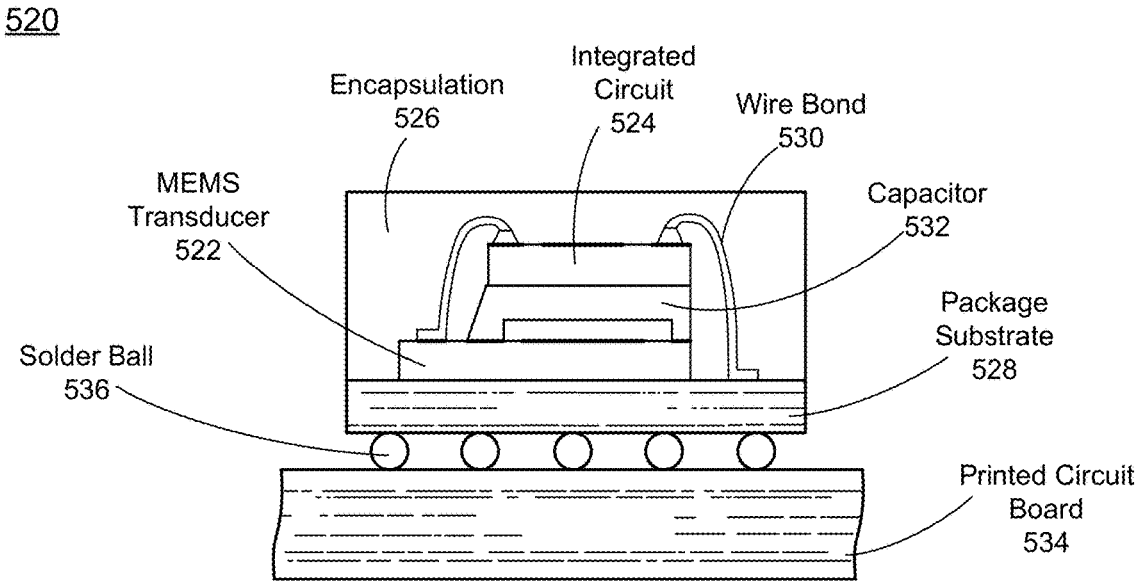
FIG. 5B illustrates a three-dimensional integration of a piezoelectric MEMS transducer with an integrated circuit, in accordance with one or more embodiments.

FIG. 5B illustrates a three-dimensional integration 520 of a MEMS transducer 522 with an integrated circuit 524, in accordance with one or more embodiments. The MEMS transducer 522 is an embodiment of the piezoelectric MEMS transducer 100 in FIGS. 1A-1B or an embodiment of any of the piezoelectric MEMS transducers 300, 310, 320, 330 in FIGS. 3A-3D. In one embodiment, the MEMS transducer 522 operates as a microphone (e.g., contact microphone). In another embodiment, the MEMS transducer 522 operates as a speaker (e.g., contact speaker). A die of the MEMS transducer 522 and a die of the integrated circuit 524 (e.g., ASIC) are encapsulated within a common encapsulation 526 and mounted three-dimensionally (i.e., vertically) relative to each other onto a package substrate 528. For example, as shown in FIG. 5B, the integrated circuit 524 is positioned above the MEMS transducer 522. A wire bond 530 may connect the MEMS transducer 522 with the package substrate 528. The package substrate 528 may be an embodiment of the substrate 134. Furthermore, a capacitor 532 may be sandwiched between the integrated circuit 524 and the MEMS transducer 522. The package substrate 528 can be placed onto a PCB 534, e.g., via multiple solder ball contacts 536.

Figure 5C:
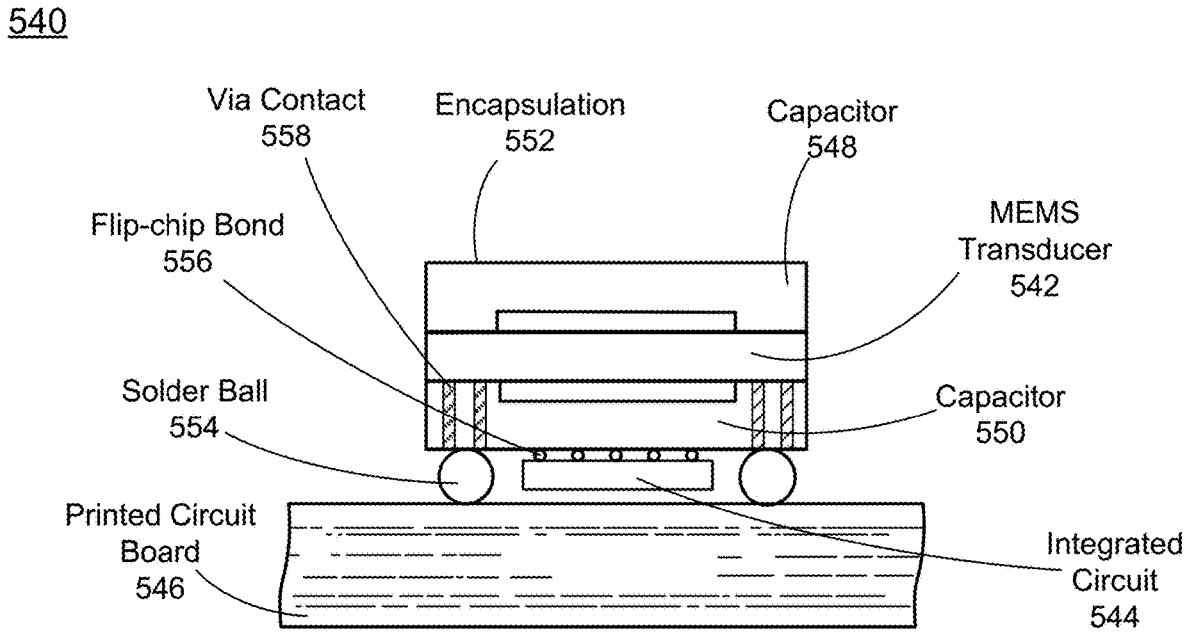
FIG. 5C illustrates another three-dimensional integration of a piezoelectric MEMS transducer with an integrated circuit, in accordance with one or more embodiments.

FIG. 5C illustrates a three-dimensional integration 540 of a MEMS transducer 542 with an integrated circuit 544, in accordance with one or more embodiments. The MEMS transducer 542 is an embodiment of the piezoelectric MEMS transducer 100 in FIGS. 1A-1B or an embodiment of any of the piezoelectric MEMS transducers 300, 310, 320, 330 in FIGS. 3A-3D. In one embodiment, the MEMS transducer 542 operates as a microphone (e.g., contact microphone). In another embodiment, the MEMS transducer 542 operates as a speaker (e.g., contact speaker). A die of the MEMS transducer 542 and a die of the integrated circuit 544 (e.g., ASIC) are mounted three-dimensionally (i.e., vertically) relative to each other, e.g., the MEMS transducer 542 is placed above the integrated circuit 544. As shown in FIG. 5C, the MEMS transducer 542 and the integrated circuit 544 are placed onto a PCB 546 as separate encapsulation packages. A pair of capacitors 548, 550 can be coupled to the MEMS transducer 542 such that, e.g., the MEMS transducer 542 is sandwiched between the capacitors 548 and the capacitors 550. An encapsulation 552 of the MEMS transducer 542 can be placed onto the PCB 546, e.g., via multiple solder ball contacts 554. The integrated circuit 544 can be coupled with the encapsulation package of the MEMS transducer 542 via multiple flip-chip bonds 556. One or more via contacts 558 connects the integrated circuit 544 and the MEMS transducer 542. The via contact 558 can be implemented as, e.g., a though-silicon via (TSV) or a through-glass via (TGV). It should be noted that the three-dimensional integrations 520, 540 have a reduced total footprint relative to the two-dimensional integration 500, which is preferred for devices that require a small footprint and have enough available space in the height dimension.

Figure 6:
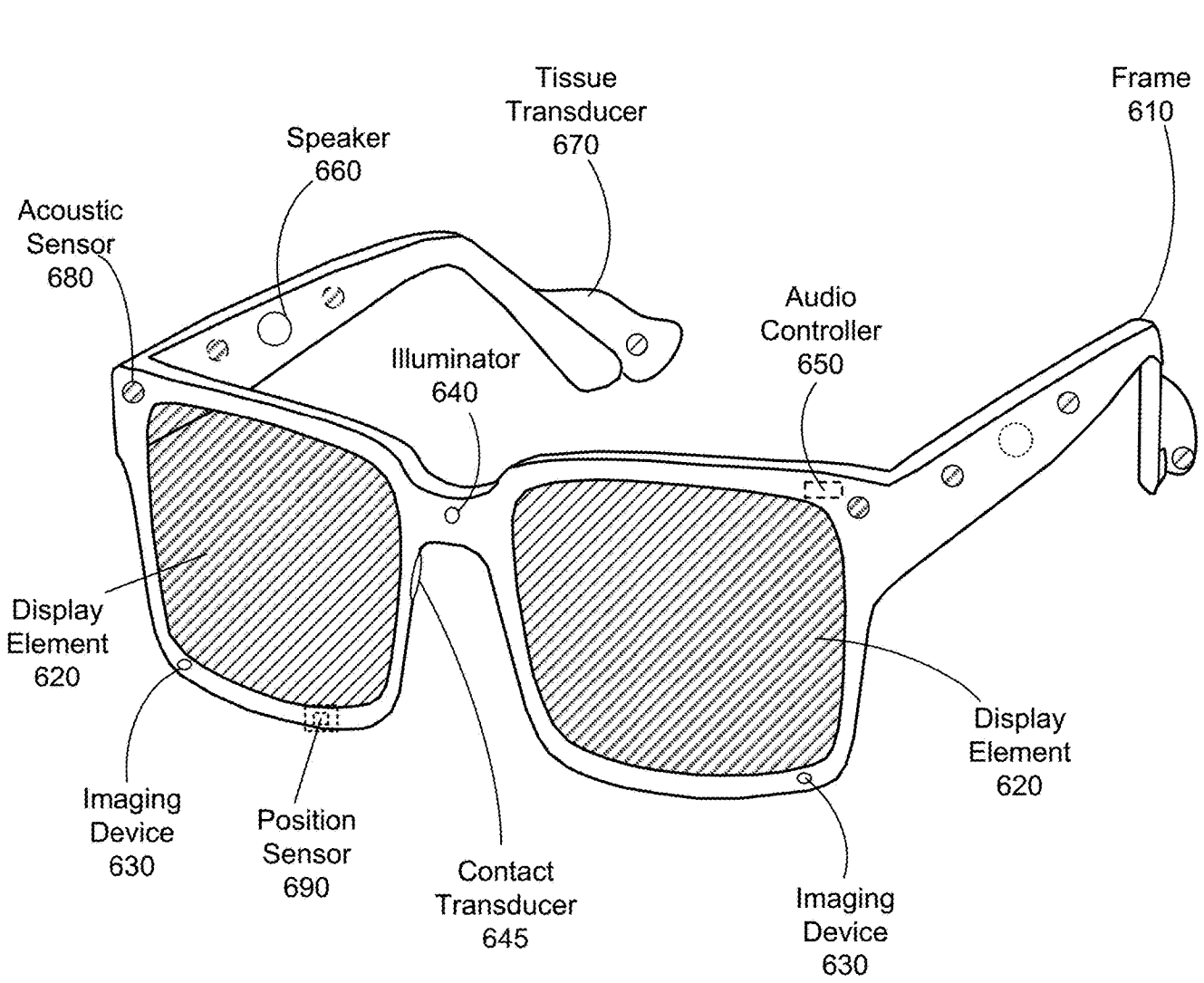
FIG. 6 is a perspective view of a headset implemented as an eyewear device, in accordance with one or more embodiments.

FIG. 6 is a perspective view of a headset 600 implemented as an eyewear device, in accordance with one or more embodiments. In some embodiments, the eyewear device is a near eye display (NED). In general, the headset 600 may be worn on the face of a user such that content (e.g., media content) is presented using a display assembly and/or an audio system. However, the headset 600 may also be used such that media content is presented to a user in a different manner. Examples of media content presented by the headset 600 include one or more images, video, audio, or some combination thereof. The headset 600 includes a frame, and may include, among other components, a display assembly including one or more display elements 620, a depth camera assembly (DCA), an audio system, and a position sensor 690. While FIG. 6 illustrates the components of the headset 600 in example locations on the headset 600, the components may be located elsewhere on the headset 600, on a peripheral device paired with the headset 600, or some combination thereof. Similarly, there may be more or fewer components on the headset 600 than what is shown in FIG. 6.

The frame 610 holds the other components of the headset 600. The frame 610 includes a front part that holds the one or more display elements 620 and end pieces (e.g., temples) to attach to a head of the user. The front part of the frame 610 bridges the top of a nose of the user. The length of the end pieces may be adjustable (e.g., adjustable temple length) to fit different users. The end pieces may also include a portion that curls behind the ear of the user (e.g., temple tip, earpiece, etc.).

The one or more display elements 620 provide image light to a user wearing the headset 600. As illustrated in FIG. 6, the headset 600 includes a display element 620 for each eye of a user. In some embodiments, the display element 620 generates image light that is provided to an eye-box of the headset 600. The eye-box is a location in space that an eye of the user occupies while wearing the headset 600. In one embodiment, a display element 620 is a waveguide display. A waveguide display includes a light source (e.g., a two-dimensional source, one or more line sources, one or more point sources, etc.) and one or more waveguides. Light from the light source is in-coupled into the one or more waveguides that output the light in a manner such that there is a pupil replication in an eye-box of the headset 600. In-coupling and/or outcoupling of light from the one or more waveguides may be done using one or more diffraction gratings. In some embodiments, the waveguide display includes a scanning element (e.g., waveguide, mirror, etc.) that scans light from the light source as the scanning element is in-coupled into the one or more waveguides. In some embodiments, one or both of the display elements 620 are opaque and do not transmit light from a local area around the headset 600. The local area is the area surrounding the headset 600. For example, the local area may be a room that a user wearing the headset 600 is inside, or the user wearing the headset 600 may be outside and the local area is an outside area. In this context, the headset 600 generates virtual reality (VR) content. Alternatively, in some embodiments, one or both of the display elements 620 are at least partially transparent, such that light from the local area may be combined with light from the one or more display elements 620 to produce artificial reality (AR) and/or mixed reality (MR) content.

In some embodiments, the display element 620 does not generate image light, and instead is a lens that transmits light from the local area to the eye-box. For example, one or both of the display elements 620 may be a lens without correction (non-prescription) or a prescription lens (e.g., single vision, bifocal and trifocal, or progressive) to help correct for defects in a user's eyesight. In some embodiments, the display element 620 may be polarized and/or tinted to protect the user's eyes from the sun.

In some embodiments, the display element 620 may include an additional optics block (not shown in FIG. 6). The optics block may include one or more optical elements (e.g., lens, Fresnel lens, etc.) that direct light from the display element 620 to the eye-box. The optics block may, e.g., correct for aberrations in some or all of the image content, magnify some or all of the image, or some combination thereof.

The DCA determines depth information for a portion of a local area surrounding the headset 600. The DCA includes one or more imaging devices 630 and a DCA controller (not shown in FIG. 6), and may also include an illuminator 640. In some embodiments, the illuminator 640 illuminates a portion of the local area with light. The light may be, e.g., structured light (e.g., dot pattern, bars, etc.) in the infrared (IR), IR flash for time-of-flight, etc. In some embodiments, the one or more imaging devices 630 capture images of the portion of the local area that include the light from the illuminator 640. As illustrated, FIG. 6 shows a single illuminator 640 and two imaging devices 630. In alternate embodiments, there is no illuminator 640 and at least two imaging devices 630.

The DCA controller computes depth information for the portion of the local area using the captured images and one or more depth determination techniques. The depth determination technique may be, e.g., direct time-of-flight (ToF) depth sensing, indirect ToF depth sensing, structured light depth sensing, passive stereo analysis depth sensing, active stereo analysis depth sensing (e.g., utilizing texture added to the scene by light from the illuminator 640), some other technique to determine depth of a scene, or some combination thereof.

The DCA may include an eye tracking unit that determines eye tracking information. The eye tracking information may comprise information about a position and an orientation of one or both eyes of a user (within their respective eye-boxes). The eye tracking unit may include one or more cameras. The eye tracking unit estimates an angular orientation of one or both eyes based on images captures of one or both eyes by the one or more cameras. In some embodiments, the eye tracking unit may also include one or more illuminators that illuminate one or both eyes with an illumination pattern (e.g., structured light, glints, etc.). The eye tracking unit may use the illumination pattern in the captured images to determine the eye tracking information. The headset 600 may prompt the user to opt in to allow operation of the eye tracking unit. For example, by opting in, the headset 600 may detect and store images of the user's eye or eye tracking information of the user.

The contact transducer 645 is a vibration sensor or an accelerometer that detects an acoustic wave through a contact surface. The contact transducer 645 is implemented as a miniature folded piezoelectric MEMS transducer. The contact transducer 645 is an embodiment of the piezoelectric MEMS transducer 100 in FIG. 1A, or an embodiment of any of the piezoelectric MEMS transducers 300, 310, 320, 330 in FIGS. 3A-3D. The contact transducer 645 outputs stress information (e.g., charge or voltage) responsive to a stress induced in the contact transducer 645 by displacement of one or more moving parts (e.g., a proof mass and/or continuous beams of the contact transducer 645). The stress information generated by the contact transducer 645 may be correlated to acoustic pressure waves originating, e.g., from the user wearing the headset 600. The stress information may be provided to the audio controller 650 for further conveyance, e.g., to other users in the local area or to remote users. By utilizing the contact transducer 645, the user's acoustic pressure waves (e.g., user's voice) can be efficiently isolated from undesired sounds (e.g., noise) in low acoustic SNR environments (e.g., a crowded restaurant that is noisy).

The contact transducer 645 is mounted on the headset 600 and coupled to a surface of a skin of a user wearing the headset 600. As shown in FIG. 6, a single contact transducer 645 is mounted on a nose pad of the headset 600. However, a number and/or mounting locations of contact transducer 645 may be different from what is shown in FIG. 6. In one or more embodiments, the contact transducer 645 can be integrated in, e.g., a temple tip, an earpiece, an IEM (not shown in FIG. 6), in an ear tip around an IEM, or some other location of the frame 610. In some embodiments, more than one contact transducer 645 can be integrated in the headset 600 at various locations of the headset 600, e.g., to increase the sensitivity and/or accuracy of collected acoustic information. In one or more embodiments, the contact transducer 645 is integrated with at least one other sensor (e.g., the acoustic sensor 680, gyroscope, ultrasonic sensor, etc.) within a single encapsulation package, e.g., the encapsulation 506 in FIG. 5A, the encapsulation 526 in FIG. 5B, or the encapsulation 552 in FIG. 5C. Incorporating the contact transducer 645 with one or more other sensors within a single encapsulation package (i.e., wafer) enables implementation of a multi-functional sensor device in a single compact packaging. In some embodiments, at least one of the speaker 660, the tissue transducer 670 and the acoustic sensor 680 can be implemented as a miniature folded piezoelectric MEMS transducer (e.g., as the miniature piezoelectric MEMS transducer 100 in FIG. 1A).

The audio system of the headset 600 provides audio content. The audio system includes a transducer array, a sensor array, and an audio controller 650. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to a user wearing the headset 600. The transducer array includes a plurality of transducers. A transducer may be a speaker 660 or a tissue transducer 670 (e.g., a bone conduction transducer or a cartilage conduction transducer). Although the speakers 660 are shown exterior to the frame 610, the speakers 660 may be enclosed in the frame 610. In some embodiments, instead of individual speakers for each ear, the headset 600 includes a speaker array comprising multiple speakers integrated into the frame 610 to improve directionality of presented audio content. The tissue transducer 670 couples to the head of the user and directly vibrates tissue (e.g., bone or cartilage) of the user to generate sound. The number and/or locations of transducers may be different from what is shown in FIG. 6.

The sensor array detects sounds within the local area of the headset 600. The sensor array includes a plurality of acoustic sensors 680. An acoustic sensor 680 captures sounds emitted from one or more sound sources in the local area (e.g., a room). Each acoustic sensor is configured to detect sound and convert the detected sound into an electronic format (analog or digital). The acoustic sensors 680 may be acoustic wave sensors, microphones, sound transducers, or similar sensors that are suitable for detecting sounds.

In some embodiments, one or more acoustic sensors 680 may be placed in an ear canal of each ear (e.g., acting as binaural microphones). In some embodiments, the acoustic sensors 680 may be placed on an exterior surface of the headset 600, placed on an interior surface of the headset 600, separate from the headset 600 (e.g., part of some other device), or some combination thereof. The number and/or locations of acoustic sensors 680 may be different from what is shown in FIG. 6. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 600.

The audio controller 650 processes information from the sensor array that describes sounds detected by the sensor array. The audio controller 650 may comprise a processor and a computer-readable storage medium. The audio controller 650 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 660, or some combination thereof.

The position sensor 690 generates one or more measurement signals in response to motion of the headset 600. The position sensor 690 may be located on a portion of the frame 610 of the headset 600. The position sensor 690 may include an inertial measurement unit (IMU). Examples of position sensor 690 include: one or more accelerometers, one or more gyroscopes, one or more magnetometers, another suitable type of sensor that detects motion, a type of sensor used for error correction of the IMU, or some combination thereof. The position sensor 690 may be located external to the IMU, internal to the IMU, or some combination thereof.

In some embodiments, the headset 600 may provide for simultaneous localization and mapping (SLAM) for a position of the headset 600 and updating of a model of the local area. For example, the headset 600 may include a passive camera assembly (PCA) that generates color image data. The PCA may include one or more RGB cameras that capture images of some or all of the local area. In some embodiments, some or all of the imaging devices 630 of the DCA may also function as the PCA. The images captured by the PCA and the depth information determined by the DCA may be used to determine parameters of the local area, generate a model of the local area, update a model of the local area, or some combination thereof. Furthermore, the position sensor 690 tracks the position (e.g., location and pose) of the headset 600 within the room.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A transducer comprising:

a substrate;

a proof mass; and a plurality of sensing structures, each sensing structure including:

a suspension beam including a first portion coupled to a respective portion of the proof mass and a second portion coupled to a respective portion of the substrate, a first sensing layer coupled to the first portion of the suspension beam, and a second sensing layer coupled to the second portion of the suspension beam, wherein outputs of the first and the second sensing layers form output information responsive to a stress induced in the suspension beam by displacement of at least one of the proof mass and the suspension beam.

2. The transducer of claim 1, wherein an area between the proof mass and each sensing structure is free of any rigid structure.

3. The transducer of claim 1, wherein:

the first portion of the suspension beam is under tension by displacement of at least one of the proof mass and the suspension beam resulting into a first output of the first sensing layer having a first polarity; and the second portion of the continuous beam is under compression by displacement of at least one of the proof mass and the suspension beam resulting into a second output of the second sensing layer having a second polarity opposite to the first polarity, the first and second outputs forming the output information.

4. The transducer of claim 3, wherein the output information includes the first and second outputs, and the first and second outputs comprise charge information.

5. The transducer of claim 3, wherein the output information includes the first and second outputs, and the first and second outputs comprise voltage information.

6. The transducer of claim 1, wherein the first and second sensing layers are located on opposite sides of the suspension beam.

7. The transducer of claim 1, wherein the suspension beam comprises a tapered beam of an arrow form.

8. The transducer of claim 1, wherein the first sensing layer comprises a first unimorph piezoelectric layer and the second sensing layer comprises a second unimorph piezoelectric layer.

9. The transducer of claim 1, wherein the first sensing layer comprises a first bimorph piezoelectric layer and the second sensing layer comprises a second bimorph piezoelectric layer.

10. The transducer of claim 1, further comprising a frame, and each sensing structure is coupled to a respective portion of the frame.

11. The transducer of claim 10, wherein a bump stop is placed between a portion of the frame and a portion of the suspension beam.

12. The transducer of claim 1, wherein an area corresponding to an unused space between the proof mass and the plurality of sensing structures is below a threshold area for a defined level of signal-to-noise ratio of the transducer.

13. The transducer of claim 1, wherein a die of the transducer and a die of an integrated circuit are mounted two-dimensionally on a package substrate placed on a printed circuit board.

14. The transducer of claim 1, wherein a die of the transducer and a die of an integrated circuit are mounted three-dimensionally on a package substrate placed on a printed circuit board.

15. The transducer of claim 1, wherein a die of the transducer and a die of an integrated circuit are mounted three-dimensionally and placed on a printed circuit board as separate encapsulation packages.

16. The transducer of claim 1, wherein the transducer is integrated with at least one other sensor within a single encapsulation package.

17. The transducer of claim 1, wherein the transducer is mounted on a headset and coupled to a surface of a skin of a user wearing the headset.

18. A transducer comprising:

a substrate;

a proof mass; and a plurality of sensing structures, each sensing structure comprising:

a suspension beam including a first portion coupled to a respective portion of the proof mass and a second portion coupled to a respective portion of the substrate, and the first portion and the second portion come together at an acute angle, a first sensing layer coupled to the first portion of the suspension beam, and a second sensing layer coupled to the second portion of the suspension beam, wherein outputs of the first and the second sensing layers form output information responsive to a stress induced in the suspension beam by displacement of the proof mass.

19. The transducer of claim 18, wherein an area between the proof mass and each sensing structure is free of any rigid structure.

20. A headset comprising:

an audio system including at least one transducer coupled to a surface of a skin of a user wearing the headset, the at least one transducer comprising:

a substrate;

a proof mass; and a plurality of sensing structures, each sensing structure comprising:

a suspension beam including a first portion coupled to a respective portion of the proof mass and a second portion coupled to a respective portion of the substrate, a first sensing layer coupled to the first portion of the suspension beam, and a second sensing layer coupled to the second portion of the suspension beam, wherein outputs of the first and the second sensing layers form output information responsive to a stress induced in the suspension beam by displacement of at least one of the proof mass and the suspension beam.

* * * * *